US009496687B2

(12) United States Patent
Kyuno et al.

(10) Patent No.: US 9,496,687 B2
(45) Date of Patent: Nov. 15, 2016

(54) METHOD FOR MANUFACTURING SPARK PLUG

(75) Inventors: Jiro Kyuno, Kiyosu (JP); Keiji Ozeki, Konan (JP); Tomoaki Kato, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 261 days.

(21) Appl. No.: 14/003,954

(22) PCT Filed: Mar. 26, 2012

(86) PCT No.: PCT/JP2012/002085
§ 371 (c)(1),
(2), (4) Date: Sep. 9, 2013

(87) PCT Pub. No.: WO2012/140838
PCT Pub. Date: Oct. 18, 2012

(65) Prior Publication Data

US 2014/0065915 A1 Mar. 6, 2014

(30) Foreign Application Priority Data

Apr. 12, 2011 (JP) ..... 2011-088049

(51) Int. Cl.
*H01T 21/02* (2006.01)
*H01T 13/58* (2011.01)

(52) U.S. Cl.
CPC ..... *H01T 21/02* (2013.01); *H01T 13/58* (2013.01)

(58) Field of Classification Search
CPC ..... H01T 13/58; H01T 21/02
See application file for complete search history.

(56) References Cited

U.S. PATENT DOCUMENTS

| | | | | |
|---|---|---|---|---|
| 2007/0040487 | A1* | 2/2007 | Kyuno et al. | 313/141 |
| 2007/0046162 | A1* | 3/2007 | Moribe et al. | 313/143 |
| 2009/0102345 | A1* | 4/2009 | Hotta et al. | 313/120 |
| 2009/0107457 | A1* | 4/2009 | Meyer et al. | 123/310 |
| 2012/0001532 | A1 | 1/2012 | Kure et al. | |

FOREIGN PATENT DOCUMENTS

| | | | |
|---|---|---|---|
| JP | 08-306468 | A | 11/1996 |
| JP | 10-32077 | A | 2/1998 |
| JP | 2006-79954 | A | 3/2006 |
| JP | 2006-343324 | A | 12/2006 |
| JP | 2007-80638 | A | 3/2007 |
| JP | 2011-34677 | A | 2/2011 |

OTHER PUBLICATIONS

International Search Report mailed Jun. 26, 2012 for the corresponding PCT Application No. PCT/JP2012/002085.

* cited by examiner

*Primary Examiner* — Nimeshkumar Patel
*Assistant Examiner* — Jacob R Stern
(74) *Attorney, Agent, or Firm* — Leason Ellis LLP

(57) ABSTRACT

A method for manufacturing a spark plug includes an assembling step of assembling an insulator into a metallic shell by insertion of the insulator into the metallic shell from an axially rear end opening portion of the metallic shell. The assembling step includes a displacement restricting step of restricting a relative positional displacement between the metallic shell and the insulator in a radial direction intersecting with the axial direction so as to reduce eccentricity between the axis of the metallic shell and the axis of the insulator to a predetermined value or less, while allowing a relative positional displacement between the metallic shell and the insulator in the axial direction. In the assembling step, whether or not the insulator is cracked in the assembling step is judged by detecting acoustic emission from the insulator.

7 Claims, 10 Drawing Sheets

METHOD FOR MANUFACTURING SPARK PLUG

CROSS-REFERENCE TO RELATED PATENT APPLICATIONS

This application is a U.S. National Phase Application under 35 U.S.C. §371 of International Patent Application No. PCT/JP2012/002085, filed Mar. 26, 2012, and claims the benefit of Japanese Patent Application No. 2011-088049, filed on Apr. 12, 2011, all of which are incorporated by reference in their entirety herein. The International Application was published in Japanese on Oct. 18, 2012 as International Publication No. WO/2012/140838 under PCT Article 21(2).

FIELD OF THE INVENTION

The present invention relates to a method for manufacturing a spark plug.

BACKGROUND OF THE INVENTION

A known spark plug for use in an internal combustion engine includes a metallic shell having a tool engagement portion and a mounting thread formed thereon, and a ceramic insulator (insulator) inserted into a through hole which extends through the metallic shell in the axial direction. Such a spark plug is configured such that spark discharges are generated between a forward end portion of a center electrode attached to the ceramic insulator and a ground electrode joined to a forward end portion of the metallic shell.

PRIOR ART DOCUMENTS

Patent Documents

Patent Document 1: Japanese Patent Application Laid-Open (kokai) No. 10-32077

Patent Document 2: Japanese Patent Application Laid-Open (kokai) No. 2007-80638

Patent Document 3: Japanese Patent Application Laid-Open (kokai) No. 8-306468

Patent Document 4: Japanese Patent Application Laid-Open (kokai) No. 2006-79954

Problems to be Solved by the Invention

In the process of manufacture of a spark plug, cracking of an insulator may occur in some cases. Whether or not the insulator is cracked has been judged by actually generating a spark discharge with an assembled spark plug to thereby see if a normal spark discharge is generated.

However, a very complicated manufacturing process is required for generating spark discharges in the process of manufacture in order to judge whether or not the insulator is cracked. Also, judgment from a short-time spark discharge encounters difficulty in accurately judging whether or not the insulator is cracked.

The present invention has been conceived to solve the above-mentioned conventional problems, and an object of the invention is to provide a technique for easily judging whether or not the insulator is cracked, in the process of manufacture of a spark plug.

SUMMARY OF THE INVENTION

Means for Solving the Problems

The present invention has been conceived to solve, at least partially, the above problems and can be embodied in the following modes or application examples.

Application Example 1

A method for manufacturing a spark plug comprising the steps of:

providing a center electrode extending in an axial direction, providing an insulator having an axial bore extending therethrough in the axial direction, and holding the center electrode in an axially forward end portion of the axial bore, providing a tubular metallic shell circumferentially surrounding and holding the insulator, and assembling the insulator into the metallic shell through insertion of the insulator into the metallic shell from an axially rear end opening portion of the metallic shell, wherein the assembling step includes a displacement restricting step of restricting a relative positional displacement between the metallic shell and the insulator in a radial direction intersecting with the axial direction so as to reduce eccentricity between an axis of the metallic shell and an axis of the insulator to a predetermined value or less while allowing a relative positional displacement between the metallic shell and the insulator in the axial direction, and in the assembling step, whether or not the insulator is cracked in the assembling step is judged by detecting acoustic emission from the insulator.

According to the present application example, whether or not the insulator is cracked can be easily judged. Furthermore, according to the present application example, in assembling the metallic shell and the insulator together, a relative positional displacement between the metallic shell and the insulator in the axial direction is allowed. Thus, even when an axial error is involved with respect to the shapes of component members of a spark plug, such as the metallic shell and the insulator, a relative positional displacement between the metallic shell and the insulator in a radial direction can be sufficiently restricted; therefore, eccentricity between the axis of the metallic shell and the axis of the insulator can be greatly reduced.

Application Example 2

A method for manufacturing a spark plug according to application example 1, wherein, in the assembling step, the metallic shell is supported by a pedestal, and the acoustic emission is detected by a sensor which is installed at such a position as to be able to detect the acoustic emission conducted through the pedestal.

Acoustic emission from the insulator is easily conductible to the pedestal through the metallic shell. Therefore, according to the present application example, acoustic emission from the insulator can be accurately detected.

Application Example 3

A method for manufacturing a spark plug according to application example 2, wherein in the displacement restricting step, after the metallic shell is pressed against the pedestal, the insulator is pressed against the metallic shell while the metallic shell is held in the state of being pressed against the pedestal.

Upon establishment of a state in which the metallic shell is pressed against the pedestal, acoustic emission becomes increasingly conductible from the metallic shell to the pedestal; therefore, the sensor can easily detect the acoustic emission. Meanwhile, the insulator is likely to be cracked when pressed against the metallic shell. According to the present application example, when the insulator is pressed against the metallic shell and is cracked, since the sensor is in such a state that the sensor can easily detect acoustic emission, an accidental failure to detect cracking of the insulator can be restrained.

Application Example 4

A method for manufacturing a spark plug according to application example 3, wherein the metallic shell has a flange-like collar portion protruding radially outward from its outer circumference, and in the assembling step, the metallic shell is pressed against the pedestal through a seat surface of the collar portion, and a load per unit area of 0.5 $N/m^2$ or more is imposed on the seat surface of the collar portion.

According to the present application example, acoustic emission can be accurately detected.

Application Example 5

A method for manufacturing a spark plug according to any one of application examples 1 to 4, wherein the assembling step includes a step of pressing forward in the axial direction a talc charged between the metallic shell and the insulator.

In the step of pressing the talc, since load is imposed on the insulator, the insulator is likely to be cracked. According to the present application example, in the step of pressing the talc, cracking of the insulator, if any, can be easily detected.

Application Example 6

A method for manufacturing a spark plug according to any one of application examples 1 to 5, wherein the assembling step includes a step of crimping the rear end opening portion of the metallic shell for holding the insulator to the metallic shell.

In the step of crimping the rear end opening portion of the metallic shell, since load is imposed on the insulator, the insulator is likely to be cracked. According to the present application example, in the step of crimping the rear end opening portion of the metallic shell, cracking of the insulator, if any, can be easily detected.

Application Example 7

A method for manufacturing a spark plug according to any one of application examples 1 to 6, wherein the metallic shell has a mounting threaded portion for mounting the same to an internal combustion engine, and the mounting threaded portion has a nominal diameter of M12 or less.

In a spark plug having a nominal diameter of M12 or less, particularly, the insulator is likely to be cracked. According to the present application example, in a spark plug having a nominal diameter of M12 or less, cracking of the insulator, if any, can be easily detected.

Application Example 8

A method for manufacturing a spark plug according to any one of claims 1 to 7, further comprising a step of eliminating an in-process spark plug whose insulator has been judged to be cracked in the assembling step.

According to the present application example, since an in-process spark plug whose insulator has been judged to be cracked is eliminated, the defective in-process spark plug can be restrained from being sent to a subsequent manufacturing step.

The present invention can be embodied in various forms. For example, the present invention can be embodied in an apparatus and a method for manufacturing a spark plug, a spark plug manufactured by use of the apparatus or the method, and a spark plug inspection method.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

A. First Embodiment

A1. Structure of Spark Plug

Figure 1:
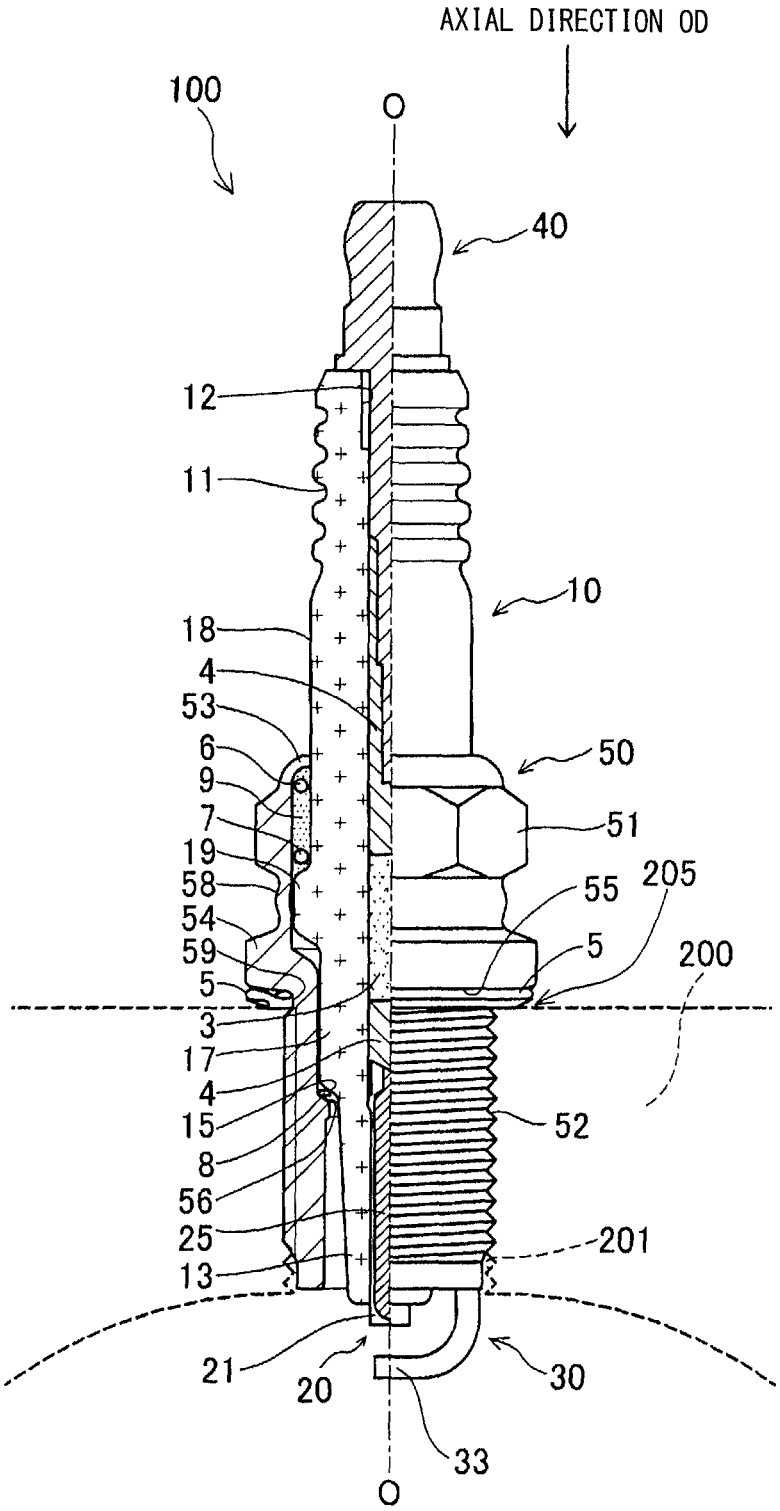
FIG. 1 is a partially sectional view showing an example of a spark plug manufactured through application of the present invention.

FIG. 1 is a partially sectional view showing an example of a spark plug 100 manufactured through application of the present invention. In the following description, an axial direction OD of the spark plug 100 in FIG. 1 is referred to as the vertical direction in the drawings; the lower side is referred to as the forward side of the spark plug; and the upper side as the rear side. In FIG. 1, the right half with respect to an axis O-O is an external view of the spark plug 100, and the left half is a sectional view of the spark plug 100 cut by a plane which contains the axis O-O (i.e., the center axis).

A ceramic insulator 10 is an insulator formed from, for example, alumina through firing. The ceramic insulator 10 is a tubular insulator and has an axial bore 12 extending therethrough in the axial direction OD; i.e., formed along the center axis. The ceramic insulator 10 has a collar portion 19 formed substantially at the center in the axial direction OD and having the greatest outside diameter, and a rear trunk portion 18 formed rearward of the collar portion 19. The rear trunk portion 18 has a corrugated portion 11 for enhancing electrically insulating properties through elongation of surface length. The ceramic insulator 10 also has a forward trunk portion 17 formed forward of the collar portion 19 and being smaller in outside diameter than the rear trunk portion 18. The ceramic insulator 10 further has a leg portion 13 formed forward of the forward trunk portion 17 and being smaller in outside diameter than the forward trunk portion 17. The leg portion 13 reduces in outside diameter toward the forward end thereof. When the spark plug 100 is mounted to an engine head 200 of an internal combustion engine, the leg portion 13 is exposed to the interior of a combustion chamber of the internal combustion engine. A stepped portion 15 is formed between the leg portion 13 and the forward trunk portion 17.

The center electrode 20 is held in the axial bore 12 of the ceramic insulator 10. The center electrode 20 protrudes from the forward end of the ceramic insulator 10 and extends rearward along the center axis O-O. The center electrode 20 is a rodlike electrode and has a structure in which a core 25 is embedded in an electrode base metal 21. The electrode base metal 21 is formed of nickel or a nickel alloy which contains nickel as a main component, such as INCONEL 600 or INCONEL 601 ("INCONEL" is a trade name). The core 25 is formed of copper or a copper alloy which contains copper as a main component, copper and the copper alloy being superior to the electrode base metal 21 in thermal conductivity. Usually, the center electrode 20 is manufactured as follows: the core 25 is embedded in the electrode base metal 21 formed into a closed-bottomed tubular shape; then, the resultant assembly is subjected to extrusion from the bottom side for prolongation. The core 25 has a substantially fixed outside diameter at its trunk portion and has a tapered forward end portion. In the axial bore 12, the center electrode 20 is electrically connected to a metal terminal 40 provided at the rear side of the ceramic insulator 10, through a seal member 4 and a ceramic resistor 3. Notably, the center electrode 20, the seal member 4, the ceramic resistor 3, and the metal terminal 40 are also collectively called the "axial core." Thus, in the following description, the ceramic insulator 10 into which the center electrode 20, the seal member 4, the ceramic resistor 3, and the metal terminal 40 (axial core) are incorporated is also called an "axial-core-incorporated insulator 102."

The metallic shell 50 is a tubular member formed of low-carbon steel and holds the ceramic insulator 10 therein. The metallic shell 50 surrounds a portion of the ceramic insulator 10 ranging from the leg portion 13 to a portion of the rear trunk portion 18.

The metallic shell 50 includes a tool engagement portion 51 and a mounting threaded portion 52. The tool engagement portion 51 is where a spark plug wrench (not shown) is engaged. The mounting threaded portion 52 of the metallic shell 50 is where a thread is formed, and is threadingly engaged with a mounting threaded hole 201 of the engine head 200 provided at an upper portion of an internal combustion engine. In this manner, by means of the mounting threaded portion 52 of the metallic shell 50 being threadingly engaged with the mounting threaded hole 201 of the engine head 200 and being tightened, the spark plug 100 is fixed to the engine head 200 of the internal combustion engine.

The metallic shell 50 has a flange-like collar portion 54 formed between the tool engagement portion 51 and the mounting threaded portion 52 and protruding radially outward. An annular gasket 5 formed by folding a sheet material is fitted to a screw neck 59 located between the mounting threaded portion 52 and the collar portion 54. When the spark plug 100 is mounted to the engine head 200, the gasket 5 is crushed and deformed between a seat surface 55 of the collar portion 54 and a peripheral-portion-around-opening 205 of the mounting threaded hole 201. By virtue of deformation of the gasket 5, a seal is established between the spark plug 100 and the engine head 200, thereby restraining leakage of combustion gas through the mounting threaded hole 201.

The metallic shell 50 has a thin-walled crimped portion 53 formed rearward of the tool engagement portion 51. The metallic shell 50 also has a buckled portion 58 formed between the collar portion 54 and the tool engagement portion 51 and thin-walled similar to the crimped portion 53. Annular ring members 6 and 7 are inserted between the outer circumferential surface of the rear trunk portion 18 of the ceramic insulator 10 and an inner circumferential surface of the metallic shell 50 ranging from the tool engagement portion 51 to the crimped portion 53. A powder of talc 9 is charged into a space between the two ring members 6 and 7. By means of a prospective crimped portion 53 being bent radially inward for crimping, the ceramic insulator 10 is fixed to the metallic shell 50. An annular sheet packing 8 intervenes between the stepped portion 15 of the ceramic insulator 10 and a stepped portion 56 formed on the inner circumferential surface of the metallic shell 50 and maintains gastightness between the metallic shell 50 and the ceramic insulator 10, thereby preventing leakage of combustion gas. A prospective buckled portion 58 is configured to be deformed radially outward through application of compressive force in the step of crimping, and thereby ensures the length of compression of the talc 9 so as to enhance gastightness within the metallic shell 50.

A ground electrode 30 is joined to the forward end of the metallic shell 50 and is bent toward the center axis O-O from the forward end of the metallic shell 50. The ground electrode 30 can be formed of a nickel alloy having high corrosion resistance, such as INCONEL 600 ("INCONEL" is a trade name). Welding can be employed for joining the ground electrode 30 to the metallic shell 50. A distal end portion 33 of the ground electrode 30 faces the center electrode 20.

An unillustrated high-voltage cable is connected to the metal terminal 40 of the spark plug 100 through a plug cap (not shown). Spark discharge is generated between the ground electrode 30 and the center electrode 20 through application of high voltage between the metal terminal 40 and the engine head 200.

Although unillustrated in FIG. 1, in order to improve resistance to spark-induced erosion, an electrode tip which contains a high-melting-point noble metal as a main component is joined to each of the center electrode 20 and the ground electrode 30. Specifically, an electrode tip formed of, for example, iridium (Ir) or an Ir alloy which contains iridium as a main component and one or more additive elements selected from among platinum (Pt), rhodium (Rh), ruthenium (Ru), palladium (Pd), and rhenium (Re) is joined to the forward end surface of the center electrode 20. Also, an electrode tip formed of platinum or a platinum alloy which contains platinum as a main component is joined to the surface of the distal end portion 33 of the ground electrode 30 which faces the center electrode 20.

A2. Spark Plug Manufacturing Process

Figure 2:
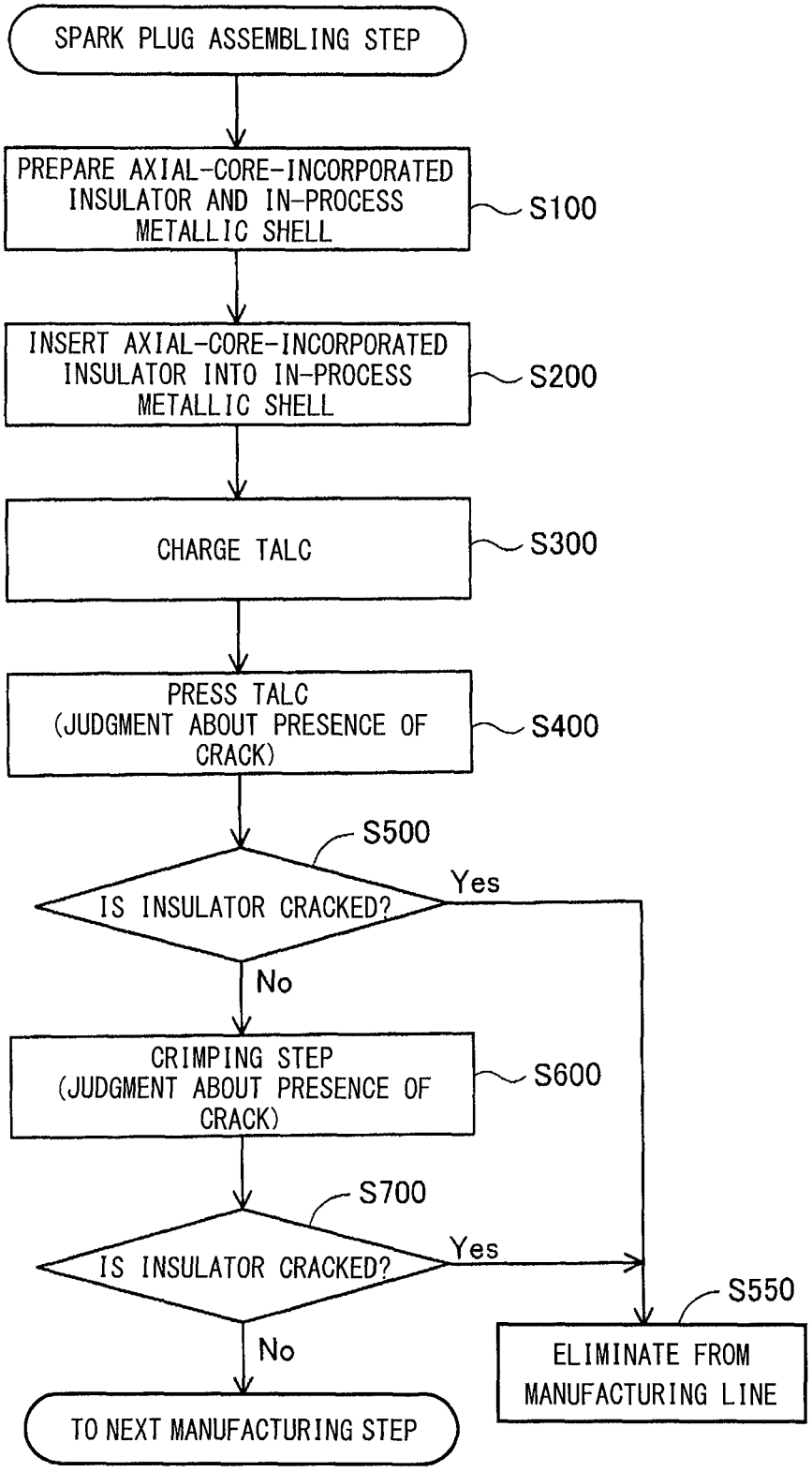
FIG. 2 is a flowchart showing a spark plug assembling step in a spark plug manufacturing process.
Figure 3:
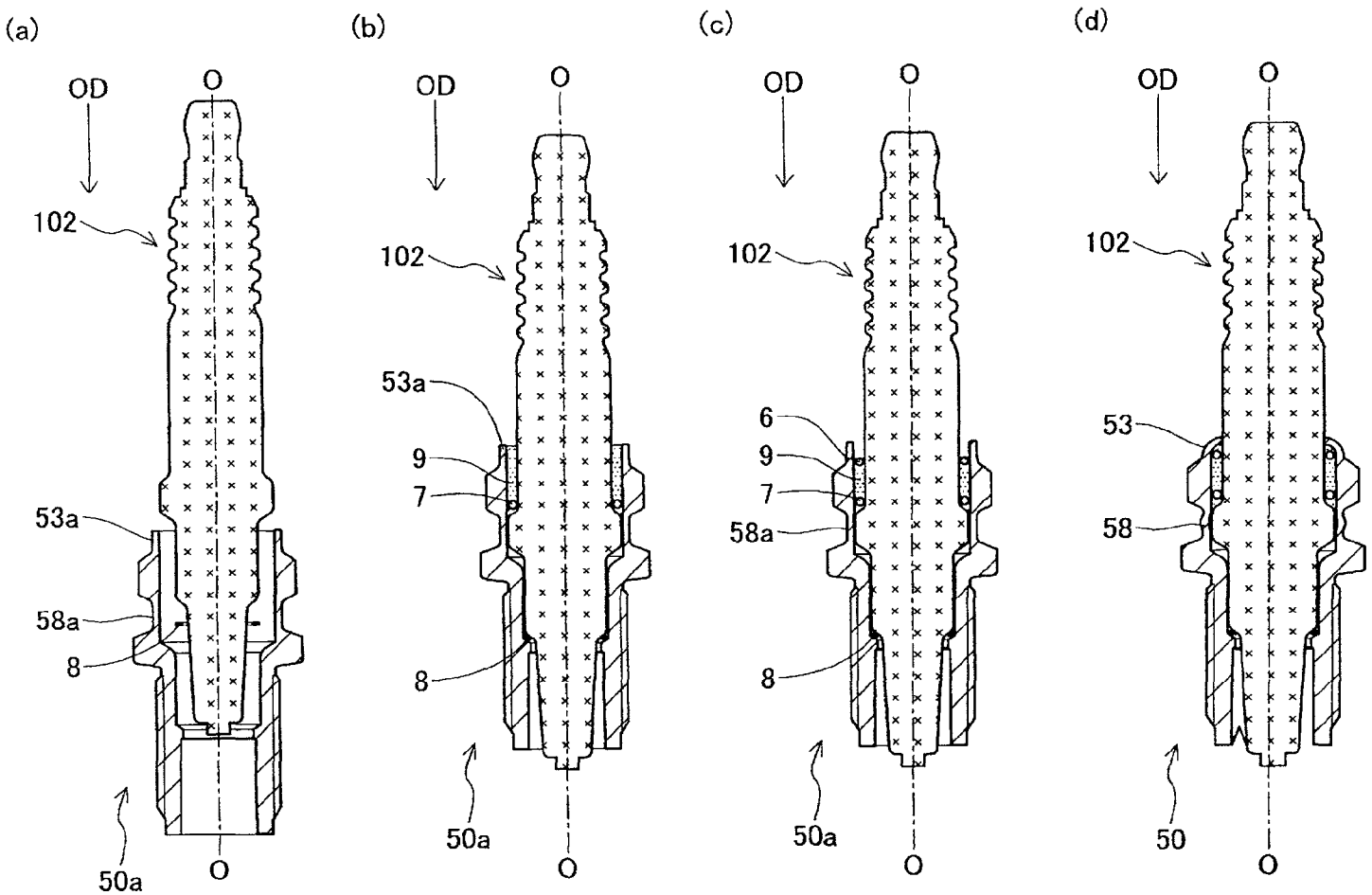
FIG. 3 is a process drawing showing a spark plug assembling step.

FIG. 2 is a flowchart showing a spark plug assembling step in a process of manufacture of the spark plug 100. FIG. 3 is a process drawing showing the spark plug assembling step. In the spark plug assembling step, first, the axial-core-incorporated insulator 102 and an in-process metallic shell 50*a* are prepared (step S100 in FIG. 2). The in-process metallic shell 50*a* has cylinderlike tubular portions 53*a* and 58*a* (FIG. 3 (*a*)) which are to become the crimped portion 53 and the buckled portion 58, respectively, of the metallic shell 50 (FIG. 1).

In step S200, the sheet packing 8 and the axial-core-incorporated insulator 102 are inserted, in this order, into the in-process metallic shell 50*a* in the axial direction OD (FIG. 3 (*a*)). After insertion of the axial-core-incorporated insulator 102 into the in-process metallic shell 50*a*, in step S300, the ring member 7 is inserted into and the talc 9 is charged into a space between the axial-core-incorporated insulator 102 and the in-process metallic shell 50*a* (FIG. 3 (*b*)). At this time, the talc 9 is charged up to near the rear end of the tubular portion 53*a*.

After insertion of the ring member 7 and charge of the talc 9, in step S400, the talc 9 is pressed from above in the axial direction OD and is thereby compressed in the axial direction OD. As a result of the ring member 7 and the talc 9 being pressed in the axial direction OD, the axial-core-incorporated insulator 102 is pressed forward within the in-process metallic shell 50*a* and is thereby assembled to the in-process metallic shell 50*a*. Subsequently, the ring member 6 is disposed on the upper end of the talc 9 (FIG. 3 (*c*)).

In the present embodiment, in the step of pressing the talc 9, acoustic emission from the axial-core-incorporated insulator 102 is detected to thereby judge whether or not the axial-core-incorporated insulator 102 is cracked. Where to dispose an acoustic emission sensor (hereinafter, may be referred to as the "AE sensor") for detecting acoustic emission, etc., will be described later. When the axial-core-incorporated insulator 102 is judged free from crack (step S500: No), the axial-core-incorporated insulator 102 proceeds to the next crimping step. When the axial-core-incorporated insulator 102 is judged to be cracked (step S500: Yes), the axial-core-incorporated insulator 102 does not proceed to the next crimping step, but is eliminated from a manufacturing line (step S550).

After the step of pressing the talc, in step S600, the in-process metallic shell 50*a* is subjected to crimping to thereby form the crimped portion 53 and the buckled portion 58; thus, the in-process metallic shell 50*a* becomes the metallic shell 50 (FIG. 3 (*d*)).

In the present embodiment, similar to the above-mentioned step of pressing the talc 9, in the crimping step, acoustic emission from the axial-core-incorporated insulator 102 is also detected for judging whether or not the axial-core-incorporated insulator 102 is cracked. When the axial-core-incorporated insulator 102 is judged free from crack (step S700: No), the axial-core-incorporated insulator 102 proceeds to the next manufacturing step. When the axial-core-incorporated insulator 102 is judged to be cracked (step S700: Yes), the axial-core-incorporated insulator 102 does not proceed to the next manufacturing step, but is eliminated from the manufacturing line (step S550).

Figure 4:
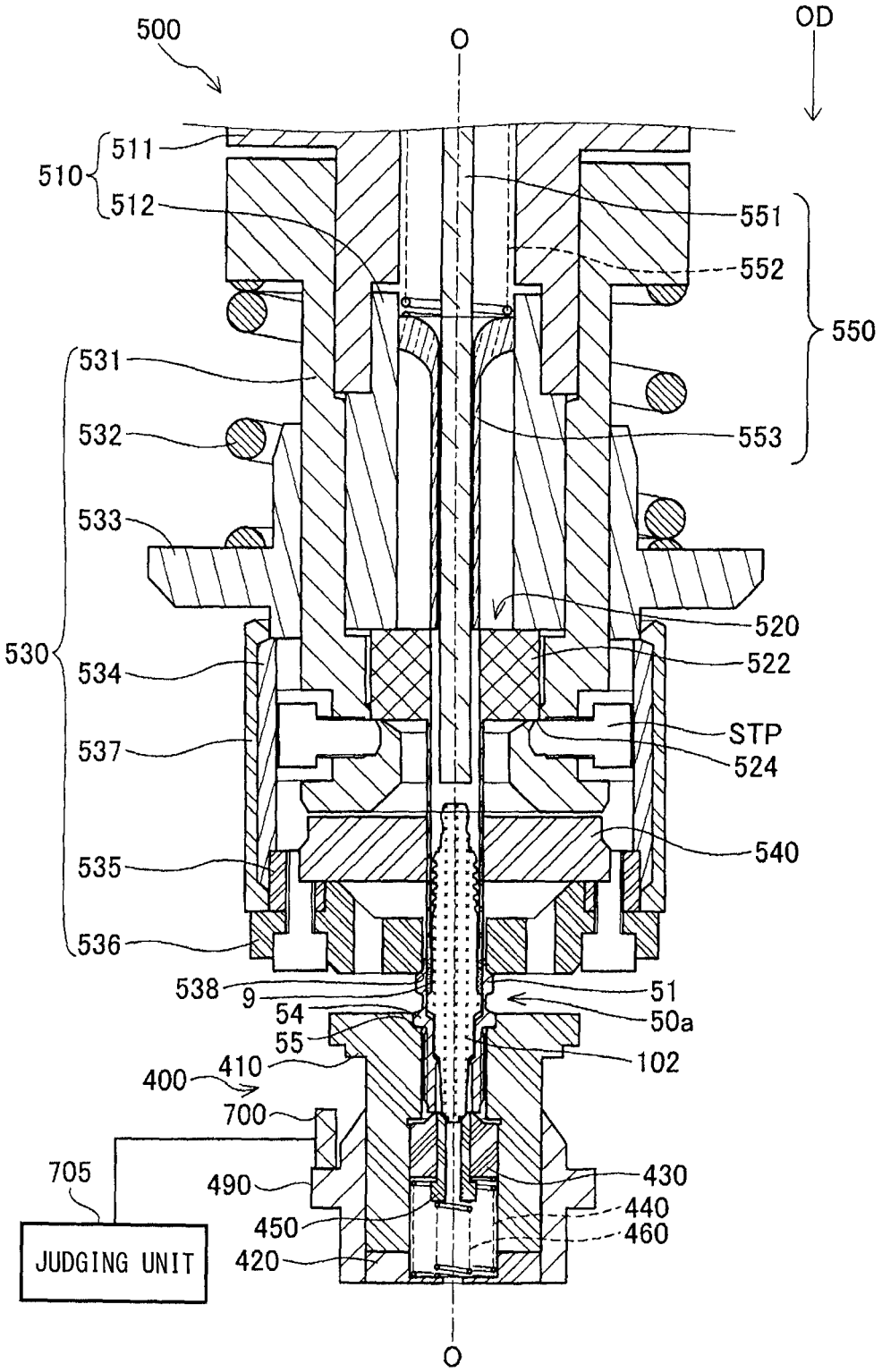
FIG. 4 is a sectional view showing the configuration of apparatus for assembling an axial-core-incorporated insulator to an in-process metallic shell.

FIG. 4 is a sectional view showing the configuration of apparatus for assembling the axial-core-incorporated insulator 102 to the in-process metallic shell 50*a*. As shown in FIG. 4, after the step of charging the talc 9, the in-process metallic shell 50*a* into which the axial-core-incorporated insulator 102 is inserted is disposed in a pedestal 400. Then, a talc pressing apparatus 500 presses the talc 9 from above.

In FIG. 4, for convenience sake, illustration of the ring member 7 is omitted. The pedestal 400 is fixed to a fixing base 490. However, after the step of pressing the talc 9, the pedestal 400 is separated from the fixing base 490 and is then conveyed, together with the in-process metallic shell 50*a* and the axial-core-incorporated insulator 102, to a manufacturing apparatus in the next manufacturing step (crimping step).

The pedestal 400 has a support die 410; a bottom member 420; a metallic-shell restricting member 430; an outer spring 440 which urges upward the metallic-shell restricting member 430; an insulator restricting member 450; and an inner spring 460 which urges upward the insulator restricting member 450. Among these members, the support die 410, the bottom member 420, the metallic-shell-restricting member 430, the outer spring 440, and the inner spring 460 are formed of a metal having high strength, such as tool steel. Meanwhile, the insulator restricting member 450 comes into contact with the ceramic insulator 10 as will be described later. Thus, in order to restrain contamination of the ceramic insulator 10, preferably, the insulator restricting member 450 is formed of resin.

The outer spring 440 in contact with the bottom member 420 imposes, on the metallic-shell restricting member 430, an upward load greater than the weight of the in-process metallic shell 50*a*. Therefore, the in-process metallic shell 50*a* is separated upward from the support die 410. Also, the inner spring 460 in contact with the bottom member 420 imposes, on the insulator restricting member 450, an upward load greater than the weight of the axial-core-incorporated insulator 102. Therefore, the axial-core-incorporated insulator 102 is separated upward from the in-process metallic shell 50*a*. In the present embodiment, the springs 440 and 460 urge upward (i.e., rearward) the metallic-shell restricting member 430 and the insulator restricting member 450, respectively. However, other method may be employed for urging the metallic-shell restricting member 430 and the insulator restricting member 450. For example, in place of the springs 440 and 460, rubber or pneumatic springs may be employed for urging the metallic-shell restricting member 430 and the insulator restricting member 450. Generally, various elastic members can be employed for urging the metallic-shell restricting member 430 and the insulator restricting member 450.

The talc pressing apparatus 500 has a load transmission unit 510 for transmitting a pressing load; a press jig 520 for pressing the talc 9; a holding unit 530 for holding the in-process metallic shell 50*a*; a guide 540 for restricting the motion of the press jig 520 to the direction of the axis O-O; and a detaching mechanism 550 for detaching the talc-pressed in-process metallic shell 50*a* from the talc pressing apparatus 500. The detaching mechanism 550 is composed of three members 551 to 553. Various members which constitute the talc pressing apparatus 500 are formed of a metal having high strength, such as tool steel. Since the operation and function of the detaching mechanism 550 have nothing to do with the present invention, description thereof is omitted.

The load transmission unit 510 has a pressure receiving member 511 which directly receives load from a pressing apparatus, and a transmission member 512 which transmits, to the press jig 520, load in the axial direction OD received by the pressure receiving member 511. When the pressure receiving member 511 receives load in the axial direction OD, the received load is transmitted to the press jig 520 through the transmission member 512.

The holding unit 530 has a spring pressing member 531; a spring 532; a spring-pressure receiving member 533; spring-pressure transmission member 534; a guide holding member 535 which holds the guide 540; a metallic-shell contact member 536; and an outer-circumference fixing member 537 which fixes the spring-pressure transmission member 534. The guide 540 is a member for restricting the direction of movement of the press jig 520 to the direction of the axis O-O and is screwed to the guide holding member 535.

A stopper STP is screwed to the spring pressing member 531. The spring pressing member 531 receives load in the axial direction OD through a forward end 524 of a large-diameter portion 522 of the press jig 520 which comes into contact with the stopper STP. Additionally, the load received by the spring pressing member 531 is transmitted to the metallic-shell contact member 536 through the spring 532, the spring-pressure receiving member 533, the spring pressure transmission member 534, and the guide holding member 535. The metallic-shell contact member 536 has a taper portion 538 formed at a central portion of its forward end.

The in-process metallic shell 50*a* separated upward from the support die 410 of the pedestal 400 receives load in the axial direction OD through contact of the taper portion 538 with the rear end of the tool engagement portion 51 of the in-process metallic shell 50*a* and is thereby pressed against the metallic-shell restricting member 430. Thus, while the forward end position of the in-process metallic shell 50*a* is being restricted by the metallic-shell restricting member 430, the in-process metallic shell 50*a* moves downward and is then pressed against the support die 410.

Also, the axial-core-incorporated insulator 102 separated upward from the in-process metallic shell 50*a* receives load in the axial direction OD through the press jig 520 pressing the talc 9. Thus, while the forward end position of the axial-core-incorporated insulator 102 is being restricted by the insulator restricting member 450, the axial-core-incorporated insulator 102 moves downward and is then pressed against the in-process metallic shell 50*a*.

In the present embodiment, an AD sensor 700 is provided on the fixing base 490. The AE sensor 700 can detect acoustic emission from the axial-core-incorporated insulator 102. The AE sensor 700 is connected to a judging unit 705. In the assembling step, the judging unit 705 judges, from acoustic emission detected by the AE sensor 700, whether or not the axial-core-incorporated insulator 102 is cracked in the assembling step. Specifically, for example, when the detected acoustic emission has an amplitude greater than a predetermined one, the judging unit 705 judges that the axial-core-incorporated insulator 102 is cracked. In this manner, whether or not the axial-core-incorporated insulator 102 is cracked can be easily judged. The present embodiment employs, as the AE sensor 700, a resonant AE sensor which utilizes mechanical resonance of a detecting element.

Preferably, as in the case of the present embodiment, the AE sensor 700 is installed at such a position (in the present embodiment, on the fixing base 490) as to be able to detect acoustic emission conducted through the pedestal 400. This is for the following reason. Since the contact area between the pedestal 400 and the seat surface 55 of the collar portion 54 of the in-process metallic shell 50*a* is large, acoustic emission from the axial-core-incorporated insulator 102 is easily conductible to the pedestal 400 through the seat surface 55 of the collar portion 54 of the in-process metallic shell 50*a*. Therefore, as in the case of the present embodiment, by means of the AE sensor 700 being installed in such a position as to be able to detect acoustic emission conducted through the pedestal 400, acoustic emission from the axial-core-incorporated insulator 102 can be accurately detected.

In order to restrain an accidental failure to detect acoustic emission from the axial-core-incorporated insulator 102, preferably, the axial-core-incorporated insulator 102 is pressed against the in-process metallic shell 50*a* after the in-process metallic shell 50*a* is pressed against the support die 410 (the pedestal 400) and while the in-process metallic shell 50*a* is held in the state of being pressed against the support die 410 (the pedestal 400). This is for the following reason.

When the in-process metallic shell 50*a* is pressed against the support die 410 (the pedestal 400), the prospective metallic shell 50*a* and the pedestal 400 come into close contact with each other; therefore, acoustic emission is easily conductible from the in-process metallic shell 50*a* to the pedestal 400. That is, the AE sensor 700 installed on the fixing base 490 can easily detect acoustic emission conducted from the axial-core-incorporated insulator 102 through the in-process metallic shell 50*a*, the pedestal 400, and the fixing base 490. Meanwhile, acoustic emission is more likely to be emitted from the axial-core-incorporated insulator 102 when the axial-core-incorporated insulator 102 is pressed against the in-process metallic shell 50*a*.

That is, by means of the axial-core-incorporated insulator 102 being pressed against the in-process metallic shell 50*a* after establishment of a state in which the AE sensor 700 can easily detect acoustic emission, there can be restrained an accidental failure to detect the acoustic emission generated from the axial-core-incorporated insulator 102.

When the axial-core-incorporated insulator 102 is pressed against the in-process metallic shell 50*a*, the in-process metallic shell 50*a* is pressed against the pedestal 400 through the seat surface 55 of the collar portion 54. At this time, preferably, load per unit area which is imposed on the seat surface 55 of the collar portion 54 of the in-process metallic shell 50*a* is 0.5 $N/m^2$ or more. Through imposition of such load, acoustic emission from the axial-core-incorporated insulator 102 is sufficiently conducted from the in-process metallic shell 50*a* to the pedestal 400; therefore, the AE sensor 700 installed on the fixing base 490 can accurately detect acoustic emission from the axial-core-incorporated insulator 102. The reason for specifying the above-mentioned value will be described later.

As a result of judgment, from detected acoustic emission, about whether or not the axial-core-incorporated insulator 102 is cracked, the axial-core-incorporated insulator 102 which is judged to be cracked is eliminated from the manufacturing line. Through employment of such elimination, the cracked axial-core-incorporated insulator 102 does not proceed to the next manufacturing step; therefore, there can be restrained manufacture of a spark plug whose axial-core-incorporated insulator 102 is cracked, whereby the incidence of defective spark plugs can be greatly reduced.

Figure 5:
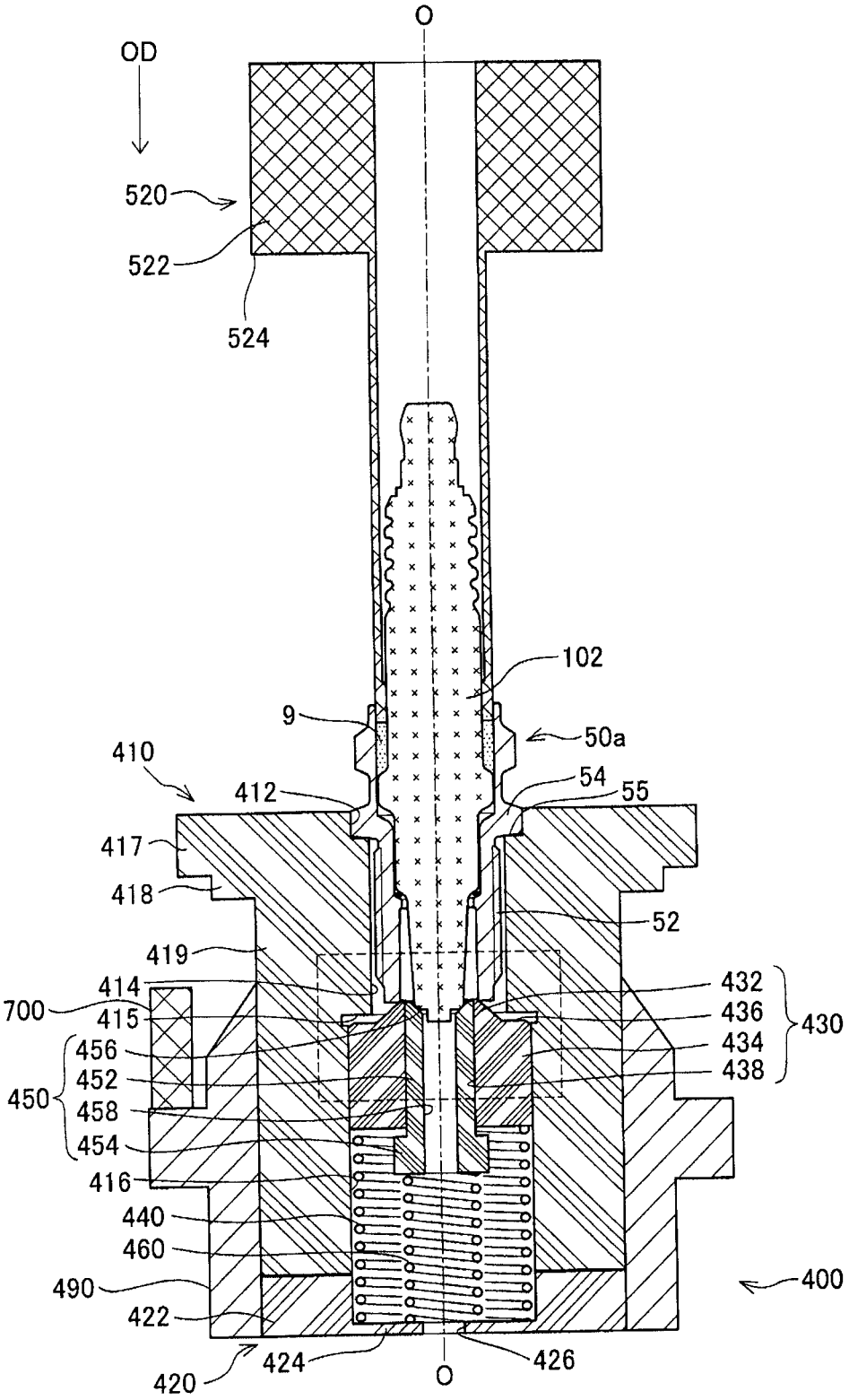
FIG. 5 is an enlarged sectional view showing a pedestal and a press jig.
Figure 6:
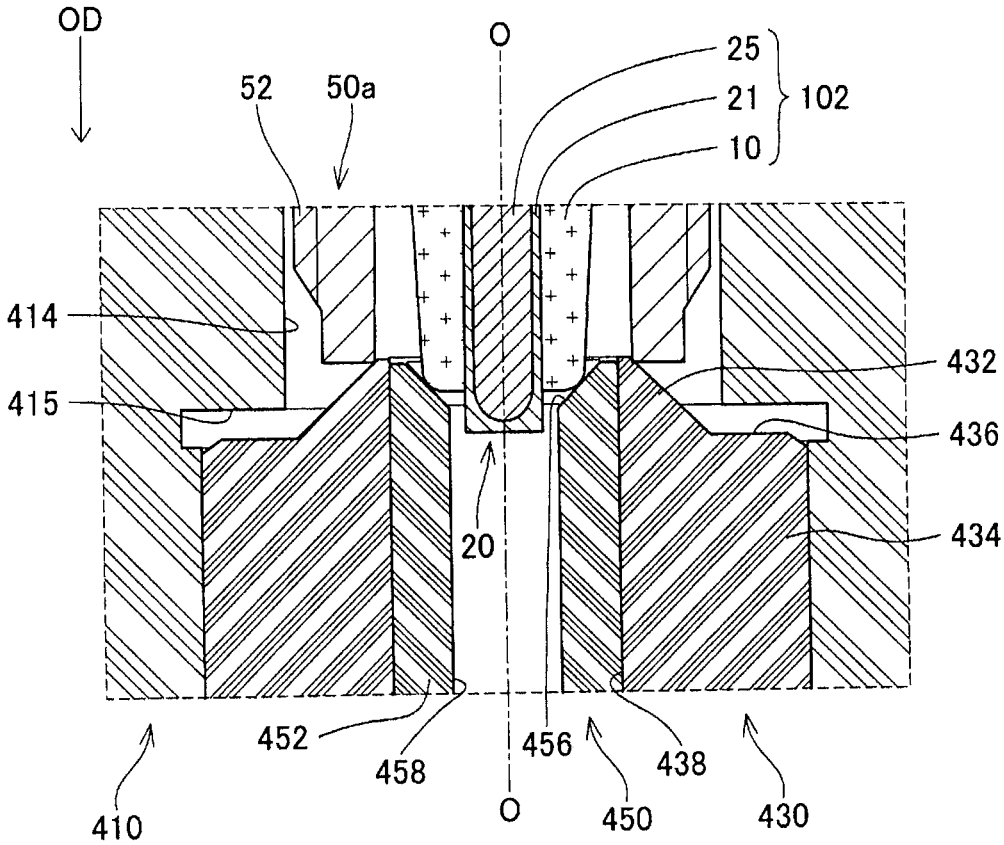
FIG. 6 is an enlarged sectional view showing a region surrounded by the broken line in FIG. 5.

FIG. 5 is an enlarged sectional view showing the pedestal 400 and the press jig 520. FIG. 6 is an enlarged sectional view showing, on a further enlarged scale, a region surrounded by the broken line in FIG. 5. In FIG. 5, for convenience sake, the illustration of the ring members 6 and 7 is omitted. According to the present embodiment, in the assembling step, a relative positional displacement between the in-process metallic shell 50*a* and the axial-core-incorporated insulator 102 in a radial direction intersecting with the axial direction OD is restricted so as to reduce eccentricity between the axis of the in-process metallic shell 50*a* and the axis of the axial-core-incorporated insulator 102 to a predetermined value or less while allowing a relative positional displacement between the in-process metallic shell 50*a* and the axial-core-incorporated insulator 102 in the axial direction OD. Hereinafter, restricting a relative positional displacement between the in-process metallic shell 50*a* and the axial-core-incorporated insulator 102 in a radial direction intersecting with the axial direction OD may be called merely "displacement restriction," and actively performing displacement restriction may be called the "displacement restricting step." Apparatus for performing the displacement restriction will be described in detail below.

The support die 410 of the pedestal 400 has two collar portions 417 and 418 disposed in the axial direction OD, the collar portions 417 and 418 differing in outside diameter, as well as a trunk portion 419 smaller in outside diameter than the collar portion 418. The support die 410 is fixed by use of the collar portions 417 and 418. The support die 410 has, at the upper side of the collar portion 417, a metallic-shell receptacle 412 having an inside diameter substantially equal to the outside diameter of the collar portion 54 of the in-process metallic shell 50*a*, and has an insertion portion 414 having an inside diameter greater than the outside diameter of the mounting threaded portion 52 of the in-process metallic shell 50*a*. The insertion portion 414 extends from substantially the center of a collar consisting of the collar portions 417 and 418 to a portion of the trunk portion 419. The trunk portion 419 has a guide hole 416 extending therein and having an inside diameter greater than that of the insertion portion 414.

The bottom member 420 supports the outer spring 440 and has an annular portion 422 having an outside diameter substantially equal to that of the trunk portion 419 of the support die 410, and a plate portion 424 extending radially inward at the bottom end of the annular portion 422. The plate portion 424 has a through hole 426 formed at its center and being smaller in inside diameter than the inner spring 460. The provision of the through hole 426 restrains an increase in inner pressure of the pedestal 400 in inserting the in-process metallic shell 50*a* into the pedestal 400 and in assembling the axial-core-incorporated insulator 102 into the in-process metallic shell 50*a*. The bottom member 420 is fixed to the support die 410 by means of, for example, unillustrated screws.

The metallic-shell restricting member 430 has a taper portion 432 whose outside diameter gradually increases in the axial direction OD (downward in FIG. 4) from a side toward the in-process metallic shell 50*a* (i.e., from the upper side), and a trunk portion 434 whose outside diameter is substantially equal to the inside diameter of the guide hole 416 of the support die 410. Thus, the metallic-shell restricting member 430 can move in the direction of the axis O-O in relation to the support die 410. Since an upper end surface 436 of the trunk portion 434 is a plane perpendicular to the axis O-O, through contact of the upper end surface 436 with a lower end surface 415 of the insertion portion 414, an upper limit position is determined for the metallic-shell restricting member 430. The metallic-shell restricting member 430 also has a guide hole 438 which extends along the axis O-O and into which the insulator restricting member 450 is inserted.

The insulator restricting member 450 is a tubular member and has a tubular trunk portion 452 whose outside diameter is substantially equal to the inside diameter of the guide hole 438 of the metallic-shell restricting member 430, and a collar portion 454 provided downward of the trunk portion 452. By means of the outside diameter of the trunk portion 452 being substantially equal to the inside diameter of the guide hole 438, the insulator restricting member 450 is movable relative to the metallic-shell restricting member 430 in the direction of the axis O-O. Also, through provision of the collar portion 454 located downward of the trunk portion 452, an upper limit position in relation to the metallic shell restricting member 430 is determined for the insulator restricting member 450. The insulator restricting member 450 has a taper hole 456 which is formed therein and whose diameter gradually reduces in the axial direction OD (downward in FIG. 4) from a side toward the axial-core-incorporated insulator 102 (i.e., from the upper end), and a through hole 458 extending therein and having a substantially fixed diameter.

The metallic-shell restricting member 430 has the taper portion 432 whose outside diameter gradually increases in the axial direction OD from the side toward the in-process metallic shell 50*a*. Thus, in assembling the axial-core-incorporated insulator 102 to the in-process metallic shell 50*a*, the inner surface of the forward end of the in-process metallic shell 50*a* comes into contact with the taper portion 432 of the metallic-shell restricting member 430 and is thereby radially restricted, whereby the center of the in-process metallic shell 50*a* after assembly is positioned on the axis O-O. Also, the insulator restricting member 450 has the taper hole 456 whose diameter gradually reduces in the axial direction OD from the side toward the axial-core-incorporated insulator 102. Thus, in assembling the axial-core-incorporated insulator 102 to the in-process metallic shell 50*a*, the forward end of the ceramic insulator 10 of the axial-core-incorporated insulator 102 comes into contact with the inner surface of the taper hole 456 and is thereby radially restricted, whereby the center of the axial-core-incorporated insulator 102 after assembly is positioned on the axis O-O.

According to the displacement restricting step, in assembling the axial-core-incorporated insulator 102 to the in-process metallic shell 50*a*, while being movable along the axis O-O, the axial-core-incorporated insulator 102 and the in-process metallic shell 50*a* are restricted in axial displacement. Therefore, after assembly, the centers of their forward end portions substantially coincide with each other. More specifically, the center of a forward end portion of the ceramic insulator 10 and the center of a forward end portion of the metallic shell 50 are held substantially on the axis O-O. Since the center of the center electrode 20 and the center of the ceramic insulator 10 substantially coincide with each other, the center of the center electrode 20 substantially coincides with the center of a forward end portion of the metallic shell 50, and the shortest distance between the center electrode 20 and the forward end portion of the metallic shell 50 is held at a sufficiently large value. Therefore, there can be restrained the occurrence of spark discharge between the center electrode 20 and the inner circumference of the metallic shell 50, whereby ignition can be performed more reliably in an internal combustion engine.

Furthermore, through impartment of a tubular shape to the insulator restricting member 450, there can be restrained damage to an electrode tip joined to the forward end of the center electrode 20.

As shown in FIG. 6, in the present embodiment, the outer surface of the taper portion 432 of the metallic-shell restricting member 430 and the inner surface of the taper hole 456 of the insulator restricting member 450 are conical surfaces. The employment of conical surfaces facilitates restriction of radial displacement. However, no particular limitation is imposed on the shape of the outer surface of the taper portion 432 and on the shape of the inner surface of the taper hole 456, so long as the outer surface of the taper portion 432 increases in outside diameter in a predetermined direction (the axial direction OD), and the inner surface of the taper hole 456 reduces in inside diameter in the predetermined direction. For example, the taper portion 432 may have a cylindrical surface which conforms to the shape of a forward end portion of the metallic shell 50. Also, the inner surface of the taper hole 456 may be curved so as to conform to the outer shape of a forward end portion of the ceramic insulator 10.

Figure 7:
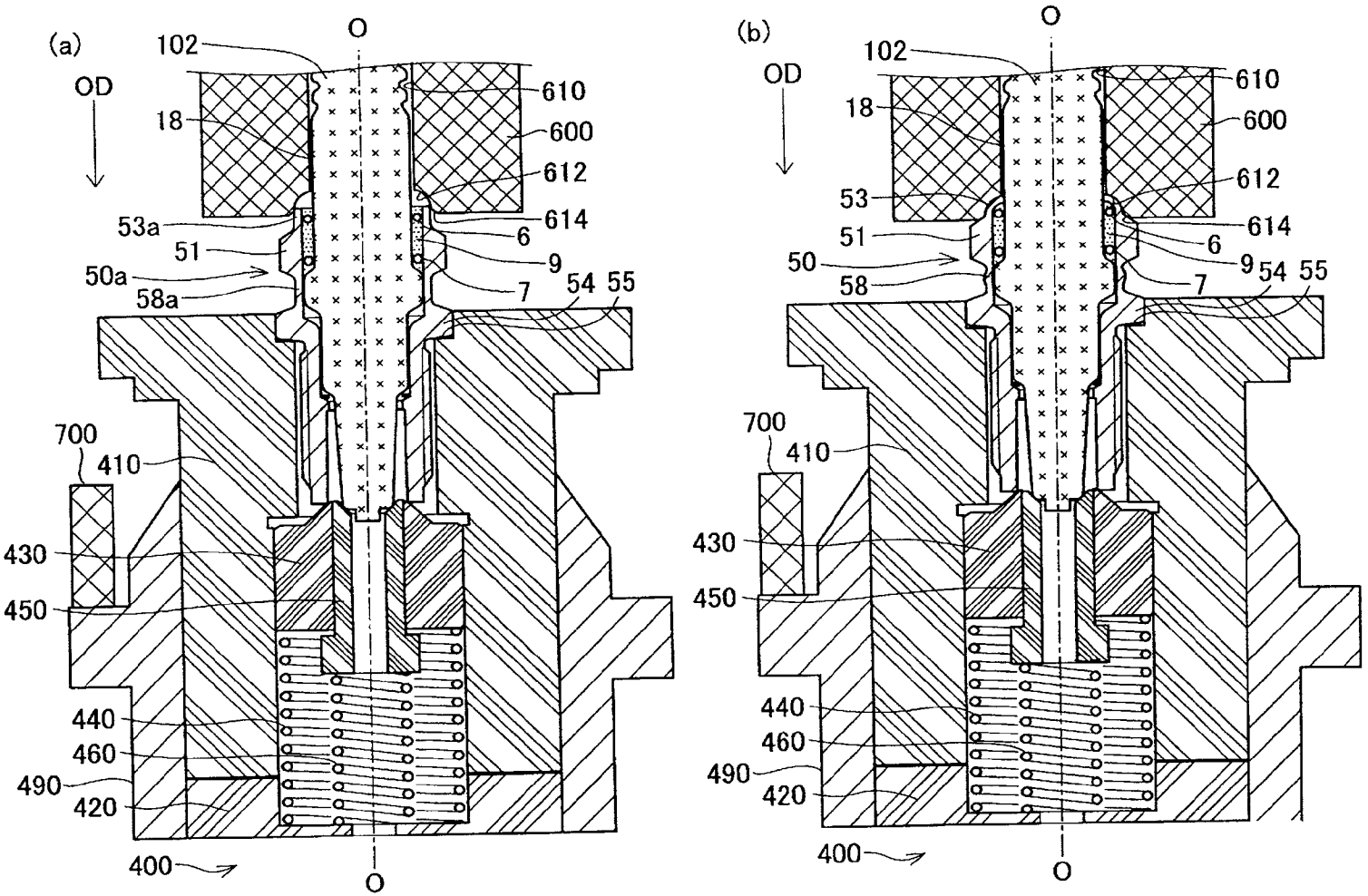
FIG. 7 is a set of views showing a step of crimping the in-process metallic shell.

FIG. 7 is a set of views showing a step of crimping the in-process metallic shell 50*a* in the assembling step of assembling the axial-core-incorporated insulator 102 into the in-process metallic shell 50*a*. In this crimping step, a crimping tool 600 is pressed, from above in the axial direction OD, against the in-process metallic shell 50*a* into which the axial-core-incorporated insulator 102 is inserted.

Also in the crimping step, similar to the case of the above-mentioned step of pressing the talc 9, the AE sensor 700 can detect acoustic emission from the axial-core-incorporated insulator 102, and the judging unit 705 judges, from acoustic emission detected by the AE sensor 700, whether or not the axial-core-incorporated insulator 102 is cracked in the crimping step. Therefore, also in the crimping step, whether or not the axial-core-incorporated insulator 102 is cracked can be easily judged.

The tubular crimping jig 600 has a through hole 610 extending therethrough and having an inside diameter greater than the outside diameter of the rear trunk portion 18 of the ceramic insulator 10 (FIG. 1) which partially constitutes the axial-core-incorporated insulator 102. The crimping jig 600 has a curved-surface portion 612 which is formed at the lower end (i.e., the forward end) of the through hole 610 and whose shape conforms to the outline of the crimped portion 53. The crimping jig 600 also has a contact portion 614 which is formed continuously with the outer edge of the curved-surface portion 612 and whose shape conforms to the outline of the rear end of the tool engagement portion 51.

As shown in FIG. 7(*a*), when the curved-surface portion 624 comes into contact with the tubular portion 53*a* formed at the upper end of the in-process metallic shell 50*a*, the in-process metallic shell 50*a* receives load in the axial direction OD and is thus pressed against the metallic-shell restricting member 430. Then, the in-process metallic shell 50*a* moves downward while its forward end position is restricted by the metallic-shell restricting member 430, and is then pressed against the support die 410.

In a state in which the in-process metallic shell 50*a* is pressed against the support die 410, when the crimping tool 600 is further urged in the axial direction OD, the tubular portion 53*a* is bent along the curved-surface portion 612 of the crimping tool 600 and thereby becomes the crimped portion 53. After formation of the crimped portion 53, when the crimping tool 600 moves further downward such that the contact portion 614 formed continuously with the outer edge of the curved-surface portion 624 comes into contact with the tool engagement portion 51, load is imposed on the tool engagement portion 51; consequently, the tubular portion 58*a* formed downward of the tool engagement portion 51 is buckled and becomes the buckled portion 58 (FIG. 7(*b*)).

In the crimping step, load in the axial direction OD is imposed on the talc 9 and the ring members 6 and 7, whereby the collar portion 19 of the ceramic insulator 10 imposes load in the axial direction OD on the axial-core-incorporated insulator 102. In this manner, through imposition of load in the axial direction OD on the axial-core-incorporated insulator 102, the axial-core-incorporated insulator 102 is pressed against the insulator restricting member 450. Then, the axial-core-incorporated insulator 102 moves downward while its forward end position is being restricted by the insulator restricting member 450, and is thereby fixed to the in-process metallic shell 50*a*.

In this manner, also in the crimping step, the center of a forward end portion of the axial-core-incorporated insulator 102 and the center of a forward end portion of the metallic shell 50 are positioned and fixed substantially on the axis O-O. Therefore, the center of the center electrode 20 (FIG. 1) substantially coincides with the center of a forward end portion of the metallic shell 50 (FIG. 1). Thus, since the distance between the center electrode 20 and the forward end portion of the metallic shell 50 is held at a sufficiently large value, there can be restrained the occurrence of spark discharge between the center electrode 20 and the inner circumference of the metallic shell 50, whereby ignition can be performed more reliably in an internal combustion engine, and erosion of the spark plug 100 can be reduced.

As described above, according to the first embodiment, since assembly is performed while acoustic emission from the axial-core-incorporated insulator 102 is being detected, whether or not the axial-core-incorporated insulator 102 is cracked can be judged reliably and easily.

B. Second Embodiment

Figure 8:
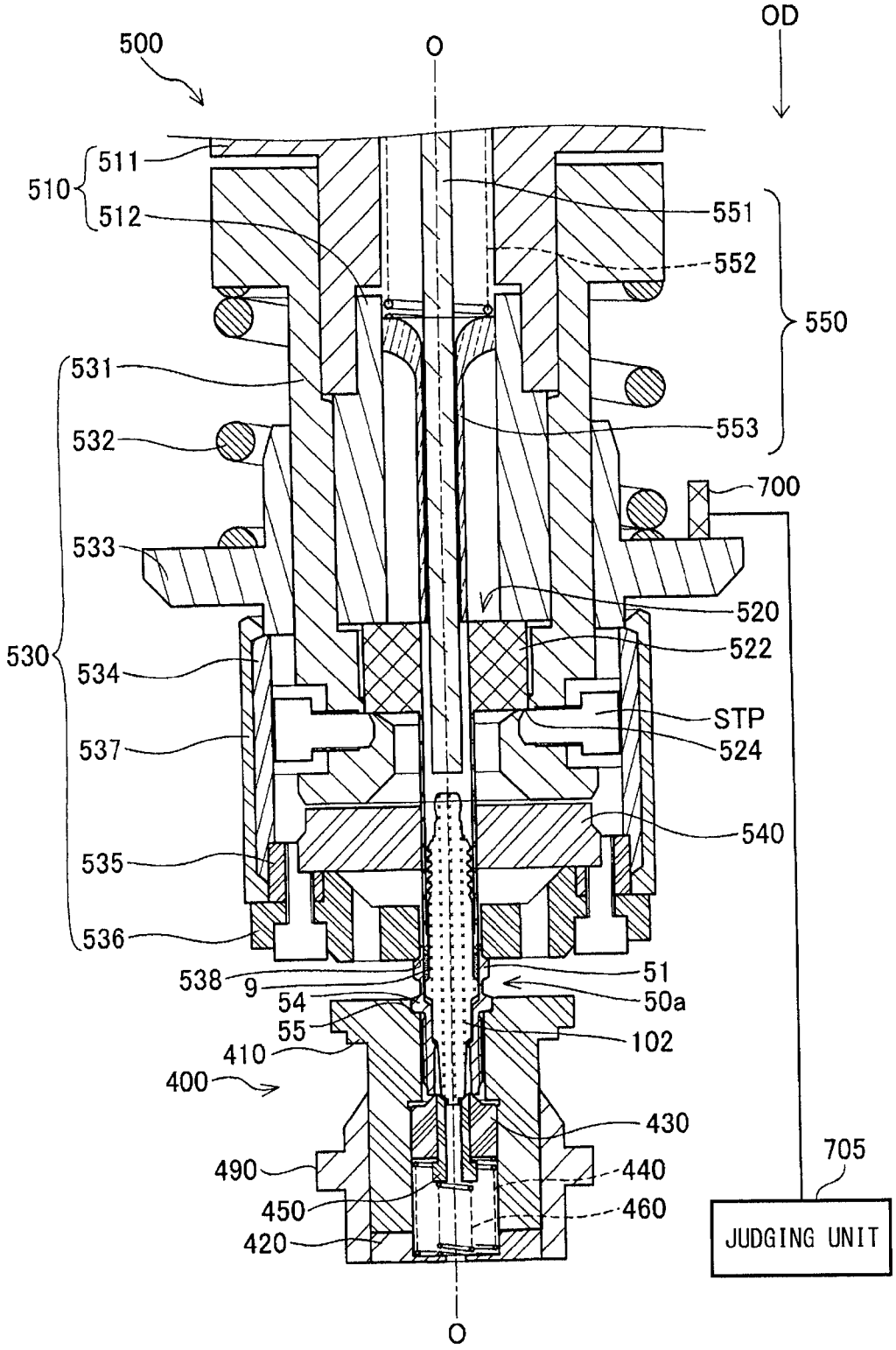
FIG. 8 is a sectional view showing the configuration of a manufacturing apparatus used in an assembling step in a second embodiment.

FIG. 8 is a sectional view showing the configuration of a manufacturing apparatus used in an assembling step in a second embodiment. The second embodiment differs from the first embodiment shown in FIG. 4 in that the AE sensor 700 is installed on the spring-pressure receiving member 533, and other configurational features are similar to those of the first embodiment. In this manner, the AE sensor 700 may be installed at a location other than the fixing base 490, so long as acoustic emission from the axial-core-incorporated insulator 102 can be detected at the location. For example, although unillustrated, the AE sensor 700 may be installed on the pedestal 400. Similarly, also in the crimping step, the AE sensor 700 may be installed at a location where acoustic emission from the axial-core-incorporated insulator 102 can be detected.

C. Experimental Example

In the present experimental example, there was examined the relationship between load per unit area imposed on the seat surface 55 of the collar portion 54 of the metallic shell 50 and accuracy in detecting acoustic emission by the AE sensor 700.

Figure 9:
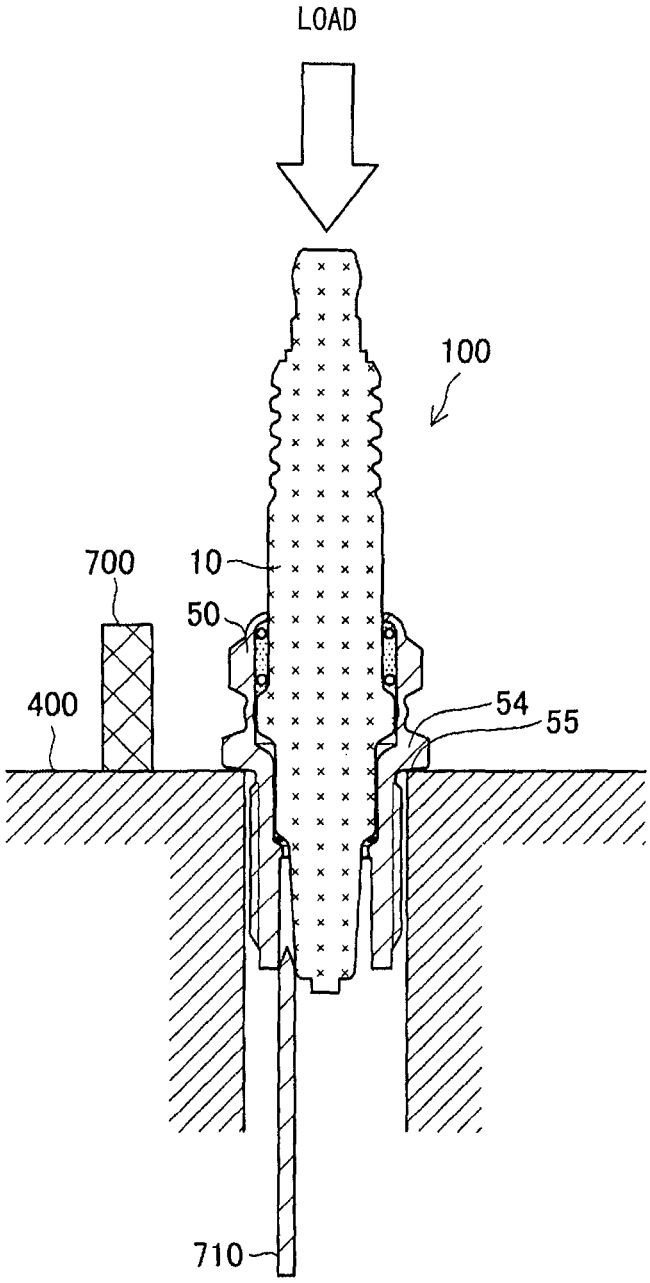
FIG. 9 is an explanatory view showing an experimental setup.

FIG. 9 is an explanatory view showing an experimental setup. In the present experimental example, while load was imposed on the spark plug 100 from the rear side, a wedge jig 710 was inserted between the metallic shell 50 and the ceramic insulator 10 in order to cause the ceramic insulator 10 to be cracked. There were measured load per unit area imposed on the seat surface 55 of the collar portion 54 of the metallic shell 50 and the maximum amplitude (V) of voltage detected by the AE sensor 700 upon occurrence of cracking in the ceramic insulator 10.

Figure 10:
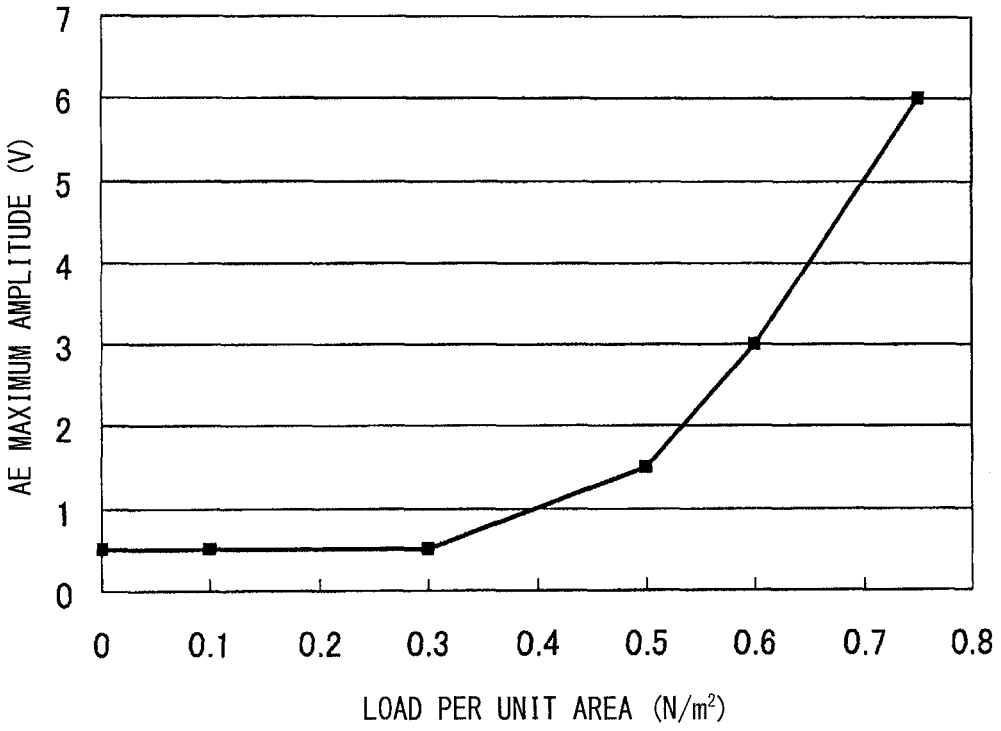
FIG. 10 is a graph showing experimental results.

FIG. 10 is a graph showing the experimental results. The horizontal axis represents load per unit area ($N/m^2$) imposed on the seat surface 55, and the vertical axis represents the maximum amplitude (V) of voltage detected by the AE sensor 700 upon occurrence of cracking in the ceramic insulator 10.

As is understandable from FIG. 10, through employment of a load per unit area of 0.5 $N/m^2$ or more imposed on the seat surface 55, acoustic emission from the ceramic insulator 10 is sufficiently conducted to the pedestal 400 through the seat surface 55 of the collar portion 54 of the metallic shell 50 such that the maximum amplitude of voltage detected by the AE sensor 700 exceeds 1 V. That is, through employment of a load per unit area of 0.5 $N/m^2$ or more imposed on the seat surface 55, the AE sensor 700 can accurately detect acoustic emission from the axial-core-incorporated insulator 102.

D. Modifications

The present invention is not limited to the above-described embodiments or modes, but may be embodied in various other forms without departing from the gist of the invention. For example, the following modifications are possible.

D1. Modification 1

The manufacturing process appearing in the description of the above embodiments is effective for a spark plug whose ceramic insulator 10 is thin and is therefore likely to be cracked, particularly for a spark plug whose mounting threaded portion has a nominal diameter of M12 or less. However, the manufacturing process appearing in the description of the above embodiments is also applicable to spark plugs having a nominal diameter of thread in excess of M12.

D2. Modification 2

The above embodiments employ the resonant AE sensor 700. However, there can be used various AE sensors; for example, a broadband AE sensor in which a damper material is affixed on a detection element so as to suppress resonance, and an R-CAST AE sensor in which a head amplifier and a dedicated preamplifier are combined.

D3. Modification 3

In the above embodiments, whether or not the insulator is cracked is judged in both of the talc pressing step and the crimping step. However, whether or not the insulator is cracked may be judged in either one of the steps.

D4. Modification 4

The above embodiments employ the judging unit 705 for judging whether or not the axial-core-incorporated insulator 102 is cracked. However, in place of employment of the judging unit 705, the following method may be employed: a display unit is provided for displaying the waveform of acoustic emission detected by the AE sensor 700, and a user observes the waveform displayed on the display unit and judges whether or not the axial-core-incorporated insulator 102 is cracked. Also, the display unit may display the value of the maximum amplitude of acoustic emission in place of the waveform.

D5. Modification 5

In the above embodiments, the assembling step is described while mentioning the talc pressing step and the crimping step, and whether or not the insulator is cracked is judged in these steps. However, the assembling step in which whether or not the insulator is cracked can be judged is not limited thereto. For example, as in the case of the above embodiments, whether or not the insulator is cracked can also be judged in other modes of the assembling step, such as a hot crimping step in which the metallic shell is crimped while being heated through application of electricity, and a preliminary cold crimping step which precedes the hot crimping step.

DESCRIPTION OF REFERENCE NUMERALS

3: ceramic resistor
4: seal member
5: gasket
6, 7: ring member
8: sheet packing
9: talc
10: ceramic insulator
11: corrugated portion
12: axial bore
13: leg portion
15: stepped portion
17: forward trunk portion
18: rear trunk portion
19: collar portion
20: center electrode
21: electrode base metal
25: core
30: ground electrode
33: distal end portion
40: metal terminal
50: metallic shell
**50*a***: in-process metallic shell
51: tool engagement portion
52: mounting threaded portion
53: crimped portion
**53*a***: tubular portion
54: collar portion
55: seat surface
56: stepped portion
58: buckled portion
**58*a***: tubular portion
59: screw neck
100: spark plug
102: axial-core-incorporated insulator
200: engine head
201: mounting threaded hole
205: peripheral-portion-around-opening
400, **400*b***: pedestal
410: support die
412: metallic-shell receptacle
414: insertion portion
415: lower end surface
416: guide hole
417, 418: collar portion

419: trunk portion
420: bottom member
422: annular portion
424: plate portion
426: through hole
430: metallic-shell restricting member
432: taper portion
434: trunk portion
436: upper end surface
438: guide hole
440: outer spring
450: insulator restricting member
452: trunk portion
454: collar portion
456: taper hole
458: through hole
460: inner spring
470: restricting member
472: taper portion
474: collar portion
476: trunk portion
480: spring
490: fixing base
500: talc pressing apparatus
510: load transmission unit
511: pressure receiving member
512: transmission member
520: press jig
522: large-diameter portion
524: forward end
530: holding unit
531: spring pressing member
532: spring
533: spring-pressure receiving member
534: spring-pressure transmission member
535: guide holding member
536: metallic-shell contact member
537: outer-circumference fixing member
538: taper portion
540: guide
550: detaching mechanism
600: crimping tool
610: through hole
612: curved-surface portion
614: contact portion
624: curved-surface portion
700: AE sensor
705: judging unit
710: wedge jig
STP: stopper

The invention claimed is:

1. A method for manufacturing a spark plug comprising the steps of:

providing a center electrode extending in an axial direction;

providing an insulator having an axial bore extending therethrough in the axial direction, and holding the center electrode in an axially forward end portion of the axial bore;

providing a tubular metallic shell circumferentially surrounding and holding the insulator; and assembling the insulator into the metallic shell through insertion of the insulator into the metallic shell from an axially rear end opening portion of the metallic shell, wherein the assembling step includes a displacement restricting step of restricting a relative positional displacement between the metallic shell and the insulator in a radial direction intersecting with the axial direction so as to reduce eccentricity between an axis of the metallic shell and an axis of the insulator to a predetermined value or less while allowing a relative positional displacement between the metallic shell and the insulator in the axial direction, and in the assembling step;

whether or not the insulator is cracked in the assembling step is judged by detecting acoustic emission from the insulator, the metallic shell is supported by a pedestal, and the acoustic emission is detected by a sensor which is installed at such a position as to be able to detect the acoustic emission conducted through the pedestal.

2. The method for manufacturing a spark plug according to claim 1, wherein in the displacement restricting step, after the metallic shell is pressed against the pedestal, the insulator is pressed against the metallic shell while the metallic shell is held in the state of being pressed against the pedestal.

3. The method for manufacturing a spark plug according to claim 2, wherein the metallic shell has a flange-like collar portion protruding radially outward from its outer circumference, and in the assembling step, the metallic shell is pressed against the pedestal through a seat surface of the collar portion, and a load per unit area of 0.5 $N/m^2$ or more is imposed on the seat surface of the collar portion.

4. The method for manufacturing a spark plug according to claim 1, wherein the assembling step includes a step of pressing forward in the axial direction a powder of talc charged between the metallic shell and the insulator.

5. The method for manufacturing a spark plug according to claim 1, wherein the assembling step includes a step of crimping the rear end opening portion of the metallic shell for holding the insulator to the metallic shell.

6. The method for manufacturing a spark plug according to claim 1, wherein the metallic shell has a mounting threaded portion for mounting the same to an internal combustion engine, and the mounting threaded portion has a nominal diameter of M12 or less.

7. The method for manufacturing a spark plug according to claim 1, further comprising:

a step of eliminating an in-process spark plug whose insulator has been judged to be cracked in the assembling step.

* * * * *